United States Patent [19]

Yoshimura et al.

[11] 3,956,082

[45] May 11, 1976

[54] ANODIZING BATH FOR COMPOSITE METAL MATERIAL COMPOSED OF ALUMINUM OR ALUMINUM ALLOY AND DIFFERENT METAL HAVING A LOWER IONIZATION TENDENCY

[75] Inventors: Chozo Yoshimura, Nara; Michiaki Hirochi, Osaka, both of Japan

[73] Assignee: Kabushiki Kaisha Shokosha, Osaka, Japan

[22] Filed: Oct. 24, 1974

[21] Appl. No.: 517,647

[52] U.S. Cl. ..... 204/58

[51] Int. Cl.[2] ..... C25D 11/06

[58] Field of Search ..... 204/58, 56 R; 106/1

[56] References Cited

OTHER PUBLICATIONS

"Surface Treatment of Al" by Wernick et al., 3rd Ed., 1964, p. 181.

*Primary Examiner*—R. L. Andrews

*Attorney, Agent, or Firm*—Larson, Taylor and Hinds

[57] ABSTRACT

An electrolytic bath for a composite metal material composed of aluminum or aluminum alloy and metal different therefrom prepared by adding 0.3 to 12% by volume of hydrogen peroxide or 1 to 15% by weight of potassium ferricyanide to 0.1 to 4.0M aqueous solution of caustic soda.

2 Claims, No Drawings

ANODIZING BATH FOR COMPOSITE METAL MATERIAL COMPOSED OF ALUMINUM OR ALUMINUM ALLOY AND DIFFERENT METAL HAVING A LOWER IONIZATION TENDENCY

The present invention relates to an electrolytic bath for composite metal materials made of aluminum or aluminum alloy and a different kind of metal such as iron, copper or stainless steel which has a lower ionization tendency than aluminum or aluminum alloy.

Acidic electrolytic bath containing sulfuric acid or oxalic acid, or alkaline electrolytic bath containing caustic soda is supposedly usable for the usual anodic oxidation of a composite metal material composed of aluminum or aluminum alloy and a different kind of metal, such as iron, copper or stainless steel, which has a smaller ionization tendency than aluminum or aluminum alloy. However, when an aluminum-iron composite material, for example, is anodically oxidized with an acidic electrolytic bath, current principally flows through iron, almost failing to form an anodic oxide film on aluminum. Moreover, iron is dissolved into the acid electrolytic bath in the form of iron sulfate and is thereby subjected to marked corrosion. Thus it is impossible to use an acid electrolytic bath for such metal material. Further a simple alkaline electrolytic bath, if used for anodizing a composite material such as one described above is unable to efficiently form an oxide film on the surface of aluminum. For example, when an aluminum-iron composite material is anodized with a bath of caustic soda at a current density of 2 A/dm$^2$ for 20 minutes, the oxide film formed on the surface of aluminum is as thin as 2 $\mu$. Thus such electrolytic bath is unsuitable for commercial operation.

Many of building materials, ornamental articles and household goods presently used are made of a composite metal material composed of iron, copper, stainless steel or like base metal and aluminum or aluminum alloy covering the base metal, but it has been impossible to anodize such composite metal material for the reasons described above. To coat such composite metal material, it has been necessary to cover the base metal with aluminum or aluminum alloy which has already been coated with an anodic oxide film. This procedure can be followed without substantial difficulties if the product to be obtained is a plate or panel which has a simple form, but if it is of a complex form as is the case with a shaped product, there arises the necessity to cover the base metal with anodized aluminum or aluminum alloy while applying pressure to the covering metal as by drawing. This entails the defect that the anodized coating may possibly be peeled off.

We have conducted extensive researches on the anodic oxidation of a composite metal material composed of aluminum or aluminum alloy and a different kind of metal and found that when such composite metal material is anodized in an electrolytic bath prepared by adding to a solution of caustic soda potassium ferricyanide or an aqueous solution of hydrogen peroxide having a high oxidizing ability in the caustic soda solution, aluminum or aluminum alloy can be effectively coated with an oxide film of an increased thickness without subjecting the other metal component to corrosion. Thus the object of the present invention has been accomplished.

Since the electrolytic bath of this invention is capable of anodizing a composite metal material, an article made of composite metal material of the type described can be directly anodized without the necessity of following the foregoing conventional procedure in which the base metal is covered with aluminum or aluminum alloy which has been previously anodized. Accordingly, there is no possibility of the resulting coating peeling off from the surface of aluminum or aluminum alloy, permitting the product to have a tough coating and retain good appearance.

The electrolytic bath of this invention is prepared by adding a suitable amount of potassium ferricyanide or of aqueous solution of hydrogen peroxide to an aqueous solution of caustic soda. The solution of caustic soda to be used has a molarity generally in the range of 0.1 to 4.0. Potassium ferricyanide is used in a proportion of 1 to 15% by weight and the aqueous solution of hydrogen peroxide is used in an amount of 0.3 to 12% by volume calculated as hydrogen peroxide, based on the total amount of the bath. Although much has yet to be clarified as to the action of potassium ferricyanide and hydrogen peroxide in the caustic soda solution on the composite metal material and as to the process in which an oxide coating is formed on aluminum or aluminum alloy with the use of the electrolytic bath of the present invention, the outstanding results achieved by the bath of this invention are presumably attributable to the following reasons. Aluminum or aluminum alloy and iron, copper, stainless steel or like metal which is smaller than aluminum or aluminum alloy in ionization tendency are not readily soluble in the aqueous solution of caustic soda. On the other hand, the aqueous solution of hydrogen peroxide, when added to the solution of caustic soda, is eventually decomposed to water and oxygen in the caustic soda solution. Accordingly, anions of oxygen intermediately produced contribute to oxidation of metal. When potassium ferricyanide is used, it is reduced to potassium ferrocyanide, and the reducing reaction contributes to oxidation of metal. Since aluminum or alloy thereof is greater than other metals in ionization tendency, it is principally oxidized almost without permitting oxidation of other metals. Furthermore, the application of current between aluminum or aluminum alloy and counter electrode promotes the above oxidation to form an oxide coating of a large thickness on the surface of aluminum or aluminum alloy.

The present invention will be described below in greater detail with reference to examples.

EXAMPLE 1

1. Preparation of electrolytic baths

Electrolytic baths were prepared by adding 1%, 2% and 3% by volume of 30% aqueous solution of hydrogen peroxide to each of 0.1M, 0.15M, 0.2M and 0.3M aqueous solutions of caustic soda.

2. Specimens

The specimens used were composite metal panels, each composed of 99.85% aluminum plate and iron plate, the area ratio of the former to the latter being 100:1, 50:1, 20:1, 4:1 and 2:1 respectively. The panels were degreased with trichloroethylene for pretreatment.

3. Conditions of electrolysis

Constant-current electrolysis was conducted for 20 minutes at current densities of 2 and 3 A/dm$^2$ using 1 l of each of the above electrolytic baths placed in a container and maintained at a temperature of 15° to 20°C. A piece of 18–8 stainless steel was used as the counter electrode as spaced from the specimen by 10 cm.

4. Test method for coating

The thickness of anodic oxide coating on the aluminum panel was measured by microscope and eddy-current-type thickness gauge and the average thickness was calculated from the values obtained. The surface of the coating was inspected with the unaided eye.

5. Results

Table 1 shows the relationship between the thickness of coating and the kind of electrolytic bath and Table 2 gives the relationship between the thickness of coating and the area ratio between the metals of the specimen.

Table 1

| Aq. soln. of $H_2O_2$ (vol.%) | Current density (A/dm²) | NaOH solution (molarity) 0.1 | 0.15 | 0.2 | 0.3 |
|---|---|---|---|---|---|
| 1 | 2 | High voltage | 5.5 μ | 1.0μ | 0 μ |
| | 3 | " | 9.0 | 4.5 | 0 |
| 2 | 3 | " | " | High voltage | 7.0 |
| | 2 | " | " | " | 6.0 |
| 3 | 3 | " | " | " | 11.0 |

Note:
"High voltage" in Table 1 (and also in Table 2 below) indicates that the initial voltage exceeded 60 V, in which case the electrolytic operation was discontinued.

Table 2

| Electrolytic bath | Current density (A/dm²) | Ratio of area (Al:Fe) 2:1 | 4:1 | 20:1 | 50:1 | 100:1 |
|---|---|---|---|---|---|---|
| 0.15M-NaOH + Aq. soln. of $H_2O_2$ (1 vol.%) | 2 | 0.5 μ | 2.0 μ | 2.5 μ | 3–3.5 μ | 5.5 μ |
| | 3 | 1.5 | 3.0 | 5.5 | 5.5–6.0 | 8.5 |
| 0.2M-NaOH + Aq. soln. of $H_2O_2$(2 vol.%) | 2 | 2.5 | 3.0 | 3.0 | 4.0 | 5.0 |
| | 3 | 3.0 | 3.0–3.5 | 5.0 | 5.5–6.0 | High voltage |
| 0.3M-NaOH + Aq. soln. of $H_2O_2$ (3 vol.%) | 2 | 1.5–2.0 | 2.5–3.0 | 3.0 | 3.5 | 5.5 |
| | 3 | 2.5 | 3.5–4.0 | 4.5 | 5.5 | 9.5 |

With the specimens having the area ratios of 100:1 and 50:1 listed in Table 2, a uniform coating was formed on the surface of aluminum plate, whereas those having the aluminum to iron ratios of not higher than 20:1 were formed with an uneven powdery coating. The iron plates were found to have only a slightly blackish colour without undergoing any marked change through the anodizing operation.

EXAMPLE 2

1. Preparation of electrolytic bath

Electrolytic baths were prepared by adding 5.0% and 10.0% by volume of 30% aqueous solution of hydrogen peroxide to each of 2.0M and 3.0M aqueous solutions of caustic soda.

2. Specimens

The same specimens as used in Example 1 were used which had the aluminum to iron area ratio of 100:1.

3. Conditions of electrolysis

Electrolysis was conducted under the same conditions as in Example 1 except that the current density was 3 A/dm².

4. Test method for coating

Same as in Example 1.

5. Results

The coatings obtained had the thicknesses listed in Table 3.

Table 3

| Ap. soln. of $H_2O_2$ | NaOH solution (molarity) 2.0 | 3.0 |
|---|---|---|
| 5.0 vol.% | 10.5 μ | 8.2 μ |
| 10.0 vol.% | 11.8 | 9.6 |

EXAMPLE 3

1. Preparation of electrolytic bath

To a 0.3M aqueous solution of caustic soda was added 3% by volume of 30% aqueous solution of hydrogen peroxide to prepare an electrolytic bath.

2. Specimens

The specimens used were composite metal panels composed of 99.85% aluminum plate and copper plate, and 99.85% aluminum plate and 18–8 stainless steel plate, respectively, the area ratio of aluminum to the other metal being 100:1. As in Example 1, the specimens were degreased with trichloroethylene.

3. Conditions of electrolysis

Constant-current electrolysis was conducted for 20 minutes at a current density of 3 A/dm² using 1 l of the above electrolytic bath placed in a container and maintained at a temperature of 15° to 20°C. Carbon was used as the counter electrode as spaced from the specimen by 10 cm.

4. Test method for coating

Same as in Example 1.

5. Results

The aluminum-copper specimen was formed with a coating having a thickness of 8.0 $\mu$, whilst the thickness of coating on the specimen composed of aluminum and 18–8 stainless steel was 7.5 $\mu$.

EXAMPLE 4

1. Preparation of electrolytic bath

To each of 0.3M, 1.0M and 2.0M aqueous solutions of caustic soda were added 5.0% and 10.0% by weight of potassium ferricyanide to prepare electrolytic baths.

2. Specimens

The specimens used were composite metal panels each composed of 99.85% aluminum plate and one of iron, copper and 18–8 stainless steel plates, the area ratio of the former to the latter being 100:1. As in Example 1, the specimens were degreased with trichloroethylene.

3. Conditions of electrolysis

Same as in Example 3.

4. Test method for coating.

Same as in Example 1.

5. Results

The thicknesses of the resulting coatings are listed in Table 4 below.

Table 4

| Specimen | Aq. soln. of $H_2O_2$(vol.%) | NaOH solution (molarity) 0.3 | 1.0 | 2.0 |
|---|---|---|---|---|
| Al + Fe | 5.0 | 7.0 $\mu$ | 4.5 $\mu$ | 3.0 $\mu$ |
| | 10.0 | 6.8 | 4.2 | 2.8 |
| Al + Cu | 5.0 | 6.5 | 4.5 | 3.2 |
| | 10.0 | 5.9 | 3.9 | 3.0 |
| Al + 18-8 stainless steel | 5.0 | 6.5 | 4.8 | 2.5 |
| | 10.0 | 6.0 | 4.7 | 2.5 |

What is claimed is:

1. An electrolyte for anodizing a composite metal material composed of aluminum or aluminum alloy and different metal having a lower ionization tendency than said aluminum or aluminum alloy, said bath consisting essentially of 0.1 to 4.0M aqueous solution of caustic soda having added thereto 0.3 to 12% by volume of hydrogen peroxide.

2. An electrolyte for anodizing a composite metal material composed of aluminum or aluminum alloy and different metal having a lower ionization tendency than said aluminum or aluminum alloy, said bath consisting essentially of 0.1 to 4.0M aqueous solution of caustic soda having added thereto 1 to 15% by weight of potassium ferricyanide.

* * * * *